United States Patent [19]

Warehime

[11] Patent Number: 5,031,907

[45] Date of Patent: Jul. 16, 1991

[54] MAGNETIC MARBLES STROKING GAMES AND APPARATUS

[76] Inventor: Norwood R. Warehime, 2021 Schuster Rd., Jarrettsville, Md. 21084

[21] Appl. No.: 422,744

[22] Filed: Oct. 17, 1989

[51] Int. Cl.[5] ..... A63F 9/00

[52] U.S. Cl. ..... 273/443

[58] Field of Search ..... 273/1 GD, 1 M, 118 R, 273/118 A, 153 S, 239; 446/137, 92, 129; 434/301

[56] References Cited

U.S. PATENT DOCUMENTS

| | | | |
|---|---|---|---|
| 920,462 | 5/1909 | Hinkle | 273/153 S |
| 2,665,912 | 1/1954 | Jordan | 446/137 X |
| 2,794,639 | 6/1957 | Christian | 273/118 R X |
| 2,943,858 | 7/1960 | Slater | 273/118 R |
| 3,406,972 | 10/1968 | Wong | 273/118 A |
| 3,814,433 | 6/1974 | Mellor | 273/153 S X |
| 4,179,122 | 12/1979 | Ray | 273/118 R X |
| 4,382,600 | 5/1983 | Viera | 273/118 R |
| 4,385,763 | 5/1983 | Moscovich | 273/153 S X |

*Primary Examiner*—Paul E. Shapiro

[57] ABSTRACT

The invention relates to a series of board/table games and playing items therefor, which include a number of small magnetic marbles, small hand-held marble stroking implements, a playing board with perimeter wall, and line markings on surface of board for playing certain types of games. Magnetic marbles, exerting magnetic fields well beyond their physical bodies, are used to form game start patterns on game board, and completing players or teams move marbles to new advantageous positions with implements by stroking them laterally, and by separating them when attached, with a downward cleaving stroke, to reach certain game end patterns. Player or team accomplishing task with least number of strokes is game winner.

2 Claims, 1 Drawing Sheet

MAGNETIC MARBLES STROKING GAMES AND APPARATUS

BACKGROUND OF THE INVENTION

1. Field of the Invention

The invention relates to magnetic marbles stroking games and apparatus which are used as a medium for competitive amusement in the field of board and table games. Players use fingers or hand-held stroking implements to position and separate attached magnetic marbles disposed on a playing surface within a game area in order to move marbles from certain start patterns of marbles to certain end patterns in the least number of strokes or least amount of time to be game winner.

2. Description of the Related Art

Search revealed no prior art directly related to subject invention. The game of common marbles made of glass might be mentioned as a game that does involve movement of marbles by impact caused by player's finger and thumb action. But no magnetism is involved. U.S. Pat. No. 606,744 to St. John is a marble game that uses magnetism and is played on a game board in which non-magnetic marbles of steel are placed in a recessed area in center of board and a magnetic rod is used to move the steel marbles to an array of small recessed spots near perimeter of board. Competing players try to move a certain number of marbles in least amount of time to be winner. But no magnetic marbles are used. Also, this game lacks elements of skill and strategy, and has very limited play variation.

Subject invention offer a simple method of playing a board and table type game using minimal number of playing elements, yet does provide players an interesting and challenging way to compete using high degrees of manual skill and mental strategy. The invention includes a wide variety of games that can be played using same playing elements. Game elements are relatively inexpensive; game rules are easy to follow; and games can be played by one to four players.

SUMMARY OF THE INVENTION

Subject invention is a board and table type game played in a rectangular playing area on a playing surface with roughened surface texture to dampen roll of small, colored magnetic marbles that are placed on the surface in certain game start patterns. Players then stroke marbles in accordance with game rules, using a stroking implement or fingers of hand to move marbles laterally to advantageous game play positions and to split apart attached marbles so they then can be moved singularly to advantageous positions. The magnetic field of the marbles extends surprisingly far beyond the physical body of the marbles, and acts as an invisible hazard awaiting players. Some games of invention require movement of competing marbles of players to pass from one area on playing surface to another and this involves head-on movement of passing marbles. Game strategy is to keep marbles unattached and in positions that will enable players to get all marbles in required game end areas by a series of strokes on and between marbles. In general, this type of game has players take alternating turns stroking marbles. Laterally applied strokes and splitting strokes have same score count or value. First player getting all of his or her marbles in proper game end area, all unattached, is winner, assuming players have equal number of turns. Other types of games of invention require players to move marbles from certain attached marbles patterns to differently attached marbles patterns. Still, other games require players to move marbles from unattached patterns to certain specific configurations of attached marble patterns. Winner of such games is player reaching desired end pattern in least number of strokes. Games can also be played against time, disregarding stroke count. Many games can also be played backward using general game rules. The players must learn to apply a delicate touch to position marbles properly. Also, strategic splitting of marbles must be learned, since in such an act, two marbles are moved and where they go should be considered for future movements. A perimeter barrier or wall around playing area is recommended to contain severely stroked marbles, especially in a splitting situation.

BRIEF DESCRIPTION OF THE DRAWINGS

Referring to the drawings.

DESCRIPTION OF THE PREFERRED EMBODIMENTS

Figure 1:
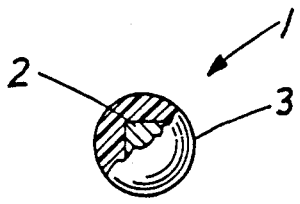
FIG. 1 is a partial view of a magnetic marble showing magnetic core and plastic outer portion.
Figure 2:
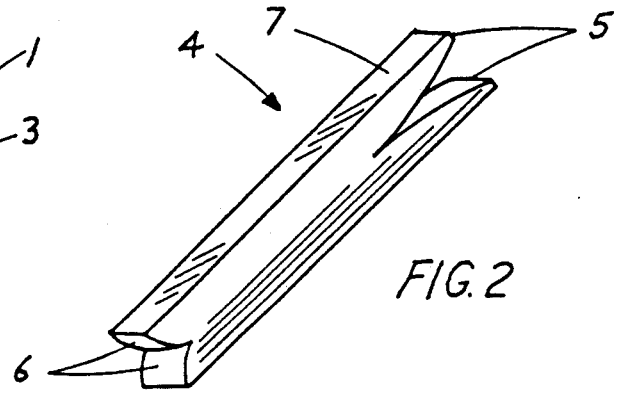
FIG. 2 is a perspective view of marble stroking implement.

FIG. 1 shows a magnetic marble 1 which is the type used in all stroking games of invention. The partial view of marble 1 reveals magnetic core 2 and outer plastic body portion 3. Polarity of marble 1 does not play any role in games. FIG. 2 shows a typical stroking implement 4 having general shape and size of a 2 parts plastic clothes pins of pincer type with spring removed and two parts cemented together. The deep notched end 5 of implement 4 is normally used for splitting attached marbles in situations where minimum of displacement of separated marbles is desired. The shallow notched end 6 of implement 4 is best used for strong splitting action. When using either end 5 or 6 of the implement 4, players make a downwardly thrusting stroke between two attached marbles. Various techniques are used by players in executing this stroking action. The flat, rectangular sides 7 of implement 4 are used mostly for lateral strokes by players to position or to have stroked marble attach strategically to another marble, hopefully with desired orientation of attached marbles which can be ideal for future marble attachements. Although not shown in drawings, fingers of player can be used optionally as stroking implements.

Figure 3A:
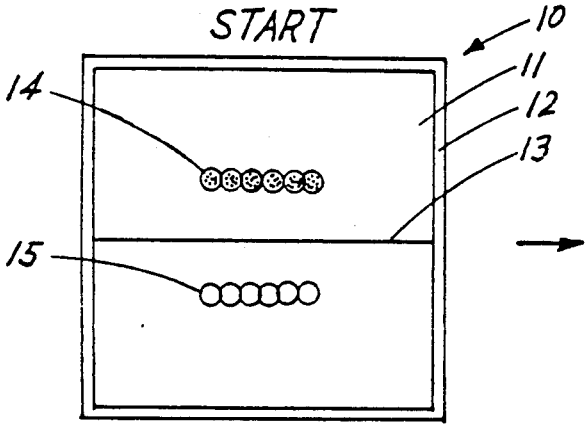
FIG. 3A is a schematic view of the start pattern of marbles for a typical game which involves attached marbles at start and end of game.
Figure 3B:
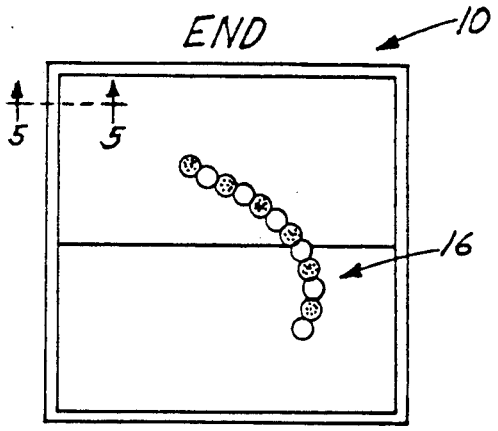
FIG. 3B is a schematic view of end pattern of marbles for game that was started in FIG. 3A.

FIG. 3A shows start pattern of marbles for a typical game which involves attached marbles at start and end of game. FIG. 3B shows end pattern of marbles for the same game started in FIG. 3A. Shown also in FIGS. 3A and 3B are overall game board 10 which includes playing surface 11, boundary containment wall 12, and center line of board 13, which is used for some game variations. Magnetic marbles 14 and 15 shown in groups represent game pieces of different colors or markings. Playing area of game is that playing surface within boundary wall 12. In the typical game shown in FIG. 3A, each player takes his or her turn and plays game through until the end pattern is reached. The general idea of the game is to split and position the two groups of marbles 14 and 15, which contain six marbles per group, and re-align all marbles into a single chain of marbles 16, but with alternating colors of attached marbles. All splitting and positioning is done with stroking implement, or optionally with fingers. Each positioning or splitting stroke has a score count value of one. Player that goes from start pattern to end pattern of game in least number of strokes is winner. Game can also be played against time, disregarding number of strokes, with winner being player with lowest time required to complete task. Game can also be played backward if so desired. Strategy in this game is to make skillful splits of attached marbles so as to make it easy to insert or attach alternating colored marbles in small chains and then finally unite them into one final end pattern chain. It is also necessary to keep the color orientation of paired or grouped marbles under control at all time so as to make it easy to add adjacent marbles of proper colors to such pairs or groups. Players soon learn other strategic maneuvers in game play, but to carry out maneuvers, a high level of manual dexterity and skill by the players is required at all times to be a winner. Since this particular game does not require a fixed size of playing area, it can be played on a surface such as that of a fairly smooth and level carpet surface or equivalent if so desired.

Figure 4A:
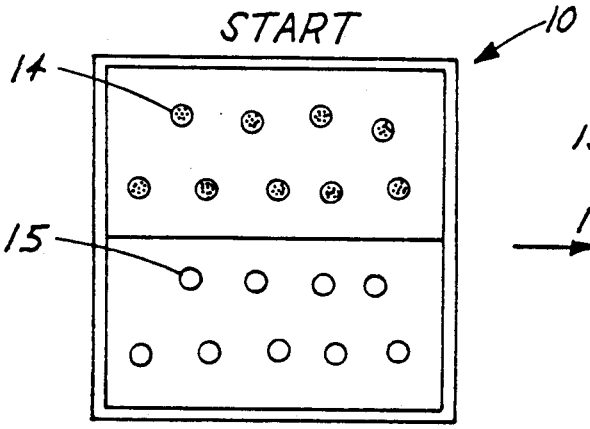
FIG. 4A is a schematic view of start pattern for a typical game which involves unattached marbles at start and end of game.
Figure 4B:
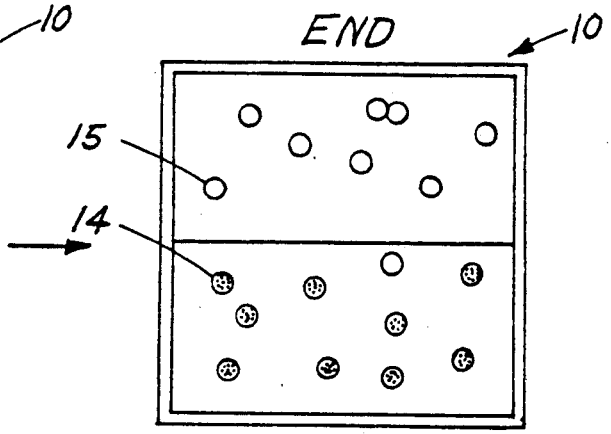
FIG. 4B is a schematic view of end pattern of marbles for game that started in FIG. 4A.
Figure 5:
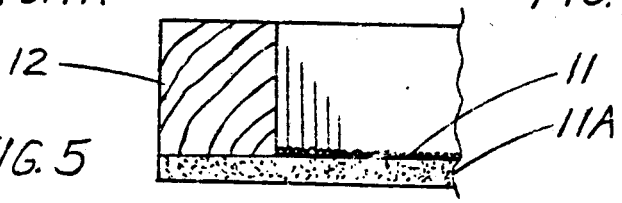
FIG. 5 is an enlarged vertical section view on line 5—5 of FIG. 3B showing features of loop pile fabric used on game board playing surface to dampen roll of magnetic marbles. Also shown is support base (11A) and the game board perimeter containment wall.

FIG. 4A shows start pattern of unattached marbles for a typical game which involves movement of marbles from one area of playing surface to another, in which all marbles for game winner in end pattern are also unattached as in FIG. 4B. Overall game board 10, playing surface 11, boundary containment wall 12, and center line of board 13 are the same as in FIGS. 3A and 3B. In this typical game, the playing area is important and is fixed by the boundary wall 12. Magnetic marbles of competing players or teams are represented by the marbles 14 and 15 which differ in color or markings, and for this game, nine (9) each of the marble types are used, and for start pattern in FIG. 4A, they are disposed in any manner but unattached and within half-board areas formed by center line 13. A typical board has the dimensions of about 18" (45 cm) on each side. Magnetic marbles 14 and 15 are about 11/16" (17 mm) in diameter and each exerts a magnetic field strong enough to attract and hold another marble which may approach within about 1¼" (31 mm) of it. This invisible magnetic field is a constant hazard in game play when marbles are required to move by each other in order to reach certain desired positions on playing surface. Also, this same magnetic field can play havoc with a player's score count when he or she tries to split two attached marbles but does not use enough force and the marbles re-unite, thus costing one score count or turn. If a player uses too strong of separating stroke, the freed marbles may travel too far and attach undesirably to other marbles, thus costing added score count or turns. In this typical game of FIGS. 4A and 4B, two players or teams take alternating turns stroking their respective marbles, each taking one turn at a time, using stroking implement 5 or fingers, with lateral and splitting strokes having the same value. Players, following game rules, move their marbles in the best manner they can and try to reach the end pattern 4B, in which, game winner with marbles of type 14, indicated by dark circles, has all nine (9) marbles on opposite side of center line 13 and all are unattached. Player or team with marbles of type marble 15, represented by blank circles, has a pair of attached marbles and one marble on the wrong side of center 13, thus requiring at least two more turns to complete task. Player or team with marbles of type marble 14 is game winner by two strokes.

Many other game formats are possible using same game items. The number of marbles and color types may be varied to best suit game format and to vary the degree of difficulty of game play.

Although particular embodiments of the invention have been illustrated in the accompanying drawings and discussed in the foregoing description, it is understood that the invention is not limited to the embodiments disclosed, but is intended to embrace any alternatives, modifications, and rearrangements and/or substitutions of parts, elements, and formats that fall within the spirit and scope of the invention.

What is claimed is:

1. Magnetic marbles stroking games and apparatus therefor, for individuals and competing players, comprising:

a. a game board, suitable for use on a level table top, comprising:

i. a generally flat, rigid sheet of non-magnetizable material forming a support base;

ii. a soft, pliable loop pile textured material forming a playing surface adapted to said support base, with said playing surface having roughened surface features to dampen roll of said marbles when stroked in game play;

iii. a continuous playing area defined on said playing surface by a low perimeter containment wall;

iv. various line markings on said playing surface defining zones for playing certain types of said games;

b. a plurality of spherical magnetic marbles, for disposition on said playing surface, with each of said marbles capable of exerting a magnetic field strong enough to attract and attach to other said marbles in the immediate vicinity;

c. at least one hand-held stroking implement in the form of a rigid elongated forked member resembling a common pincers type clothes pin, used by said players for moving one of said marbles from one position on said playing surface to another position by rendering a lateral stroke or for separating at least two of said marbles when they are attached, by rendering a downward cleaving stroke between said attached marbles, and for general score count in game play, both types of strokes have same value;

whereby said players, following rules of game play, can compete individually or with each other, in a number of said games which generally require movement of said marbles from certain game start patterns on playing surface to certain game end patterns, using said stroking implement, with winning player accomplishing said game play movement with the least number of said strokes.

2. Magnetic marbles stroking games and apparatus therefor, for individuals and competing players, comprising:

a. a game board suitable for use on a level table top, comprising:

i. a generally flat, rigid sheet of non-magnetizable material forming a support base;

ii. a sheet of soft, course, pliable textured material forming a generally flat playing surface adapted to said support base, with said playing surface having surface features to dampen roll of said marbles when stroked in game play;

iii. a continuous playing area defined on said playing surface by a low perimeter containment wall;

iv. various line markings on said playing surface defining zones for playing certain types of said games;

b. a plurality of spherical magnetic marbles, for disposition on said playing surface, with each of said marbles capable of exerting a magnetic field strong enough to attract and attach to other said marbles in the immediate vicinity;

c. at least one hand-held stroking implement in the form of a rigid elongated forked member resembling a common pincers type clothes pin, used by said players for moving one of said marbles from one position on said playing surface to another position by rendering a lateral stroke or for separating at least two of said marbles when they are attached, by rendering a downward cleaving stroke between said attached marbles, and for general score count in game play, both types of said strokes have the same value;

whereby said players, following rules of game play, can compete individually or with each other, in a number of said games which generally require movement of said marbles from certain game start patterns, using said stroking implement, to certain game end patterns on said playing surface, with winning player accomplishing said game play movement with the least number of said strokes.

* * * * *